United States Patent [19]

Damin et al.

[11] Patent Number: 5,041,231

[45] Date of Patent: Aug. 20, 1991

[54] PROCESS FOR PREPARING AN ADDITIVE FOR LUBRICATING OILS, THE ADDITIVE THUS OBTAINED AND A LUBRICATING COMPOSITION CONTAINING THE ADDITIVE

[75] Inventors: Bernard Damin, Oullins; Daniele Eber, Lyons; Roger J. Gallo, Bouc Bel Air; Paul Maldonado, Castanet Tolosan, all of France; Simon Paley, Yaounde, Cameroon

[73] Assignee: Elf France, Coubevoir, France

[21] Appl. No.: 349,153

[22] Filed: May 9, 1989

[30] Foreign Application Priority Data

Oct. 3, 1985 [FR] France ..... 85 14665

[51] Int. Cl.[5] ..... C10M 125/10

[52] U.S. Cl. ..... 252/33; 252/25; 252/33.2; 252/39; 252/42.7

[58] Field of Search ..... 252/33, 332, 39, 42.7, 252/25

[56] References Cited

U.S. PATENT DOCUMENTS

| | | | |
|---|---|---|---|
| 2,695,910 | 11/1954 | Asseff | 252/39 |
| 3,126,340 | 3/1964 | Sabol et al. | 252/33 |
| 3,524,814 | 8/1970 | Sabol et al. | 252/33 |
| 3,609,076 | 9/1971 | Sabol et al. | 252/33.2 |
| 3,857,790 | 12/1974 | Saunders et al. | 252/39 |
| 3,865,737 | 2/1975 | Kemp | 252/33.4 |
| 4,016,093 | 4/1977 | Koft, Jr. | 252/42.7 |
| 4,100,085 | 7/1978 | Peditto et al. | 252/42.7 |
| 4,137,186 | 1/1979 | Sabol | 252/33 |
| 4,148,740 | 4/1979 | Cease et al. | 252/33 |
| 4,179,385 | 12/1979 | Ali et al. | 252/33 |
| 4,200,545 | 4/1980 | Clason et al. | 252/42.7 |
| 4,218,328 | 8/1980 | Vaughan | 252/33.2 |
| 4,225,446 | 9/1980 | Arnold et al. | 252/33 |
| 4,248,718 | 2/1981 | Vaughan | 252/33 |
| 4,252,659 | 2/1981 | Ali | 252/33 |
| 4,320,015 | 3/1982 | Vaughan | 252/33.6 |
| 4,737,298 | 4/1988 | Born et al. | 252/33.2 |
| 4,749,499 | 6/1988 | Damin et al. | 252/33 |
| 4,758,360 | 7/1988 | Bernasconi et al. | 252/33 |
| 4,834,892 | 5/1989 | Damin et al. | 252/39 |

FOREIGN PATENT DOCUMENTS 0005337 11/1979 European Pat. Off. .

*Primary Examiner*—Prince E. Willis
*Assistant Examiner*—Jerry D. Johnson
*Attorney, Agent, or Firm*—Burgess, Ryan & Wayne

[57] ABSTRACT

The present invention concerns a process for preparing a basic additive for lubricating oils having an antiwear and detergent effect, the additive thus obtained and a lubricating composition containing the additive. The process consists of contacting an amino-acid in solution or in dispersion in the oil with a detergent, an alkaline-earth metal derivative, carbon dioxide in diluent oil, a hydrocarbon-based solvent, and a polar solvent in the presence of a nitrogen-based basic derivative.

15 Claims, No Drawings

PROCESS FOR PREPARING AN ADDITIVE FOR LUBRICATING OILS, THE ADDITIVE THUS OBTAINED AND A LUBRICATING COMPOSITION CONTAINING THE ADDITIVE

BACKGROUND OF THE INVENTION

This application is a continuation-in-part of U.S. Application Ser. No. 915,268, filed Oct. 3, 1986, now abandoned, the entire contents of which is incorporated herein by reference.

FIELD OF THE INVENTION

The present invention relates to a process for preparing an additive for use in lubricating oils, the additive thus obtained and a lubricating composition containing the additive.

SUMMARY OF THE PRIOR ART

Lubricants for land vehicle and marine craft motors contain high proportions of additives among which can be cited detergents, antiwear additives and a basicity reserve.

The detergents are utilized to prevent the formation of deposits of degradation compounds of the lubricant on the rings and the grooves of the pistons.

Antiwear additives act through formation of a solid or plastic thin film which separates the rubbing surfaces and thereby avoid wear of the different parts of the motor.

The most widely used antiwear additives are sulphur-based and phosphor-based derivatives, but among the numerous products presenting antiwear properties can be cited certain carboxylic acids and in particular, certain amino-acids or their derivatives described in French Patent Application No. 85 14663 entitled "Additif Aux Huiles Lubrifiantes, Comportant Un Sel Metallique D'un Acide Amine, Leur Procede De Preparation Et Compositions Lubrifiantes Renfermant Lesdits Additifs", and filed on the same day as the French application of which the present invention claims priority. These acids can have an antiwear synergy effect with the additives such as zinc dithiophosphates.

The function of the basicity reserve is to neutralize the acids formed during combustion. These acids have an undesirable effect of corroding the motor.

The basicity is provided either by ash-free or very low ash additives described in U.S. Pat. No. 4,218,328 assigned to Chevron, or by overbased additives formed through the reaction of alkaline-earth metal oxides and carbon dioxide in the presence of a surfactant. The reaction is performed in the presence of a hydrocarbon-based solvent, water, alcohol and ammonia. This process is described, for example, in U.S. Pat. No. 3,865,737.

The surfactant is of the sulfonate, phenate or salicylate type. Its function is to maintain in colloidal dispersion the alkaline-earth carbonate formed. At the same time, it exerts a detergent action.

The addition of carbon dioxide during the preparation of such overbased additives is performed through bubbling within the reaction medium.

The lubricating solution containing agents having a detergent, antiwear effect and containing a basicity reserve must remain homogenous for a long time and be sufficiently compatible with other additives such as the dispersing and the antifoam agents.

A process of preparing an additive adapted to ensure simultaneously the functions of detergents, antiwear and basicity reserve has now been developed.

The interest of such a product is that it reduces the problems of compatibility with the other additives during formulation of a lubricating oil, since a single additive is used which fulfills these three functions.

Furthermore, this process allows solubilizing in oil of compounds that are insoluble in this medium. Thus, for example, certain amino acids or their derivatives can only be introduced into an oil in their microdispersed form. The microdispersion thus obtained has a milky color since it contains amino acid crystals or amino-acid derivatives having a size greater than a micron. The basicity of these microdispersions is relatively low. On the other hand, if the amino acid or the corresponding derivative is introduced into the oil by the process according to the invention, the oil obtained has a translucid appearance since it involves a colloidal dispersion of which the size of the particles is generally smaller than 0.1 micron. Microscopic observation of the finished product furthermore shows a total absence of crystallized products.

The process of preparing an additive for lubricating oils according to the invention consists in contacting an amino-acid or amino-acid derivative in solution or in dispersion, a surfactant, an alkaline-earth derivative and carbon dioxide in a mixture of diluent oil, hydrocarbon-based solvent and polar solvent. To catalyze the formation of alkaline-earth carbonates, the reaction is carried out in the presence of a nitrogen-based basic derivative.

In a general manner, from 0.05 to 1 mole, and preferably from 0.05 to 0.2 mole of a mixture of surfactant and amino-acid or an amino-acid derivative and 0.1 to 1.5 moles of carbon dioxide per mole of alkaline-earth metal derivative are contacted. The proportion of surfactant in the mixture is comprised between 20 and 99 mole percent, and preferably between 50 and 95 mole percent. The proportion of aminoacid in the detergent-aminoacid mixture is from about 50 to about 80% by weight.

The nitrogen-based basic derivative corresponds to the general formula $R_1R_2R_3N$ in which $R_1$, $R_2$ and $R_3$ are identical or different, and represent hydrogen, a $C_1$ to $C_{12}$ alkyl group, or a $C_1$ to $C_6$ hydroxyalkyl group. These compounds can possibly be used as salts formed with organic or inorganic acids.

Among these nitrogen-based basic derivatives are particularly suitable, ammonia, ammonium carbonate and ethanolamine.

By the term "amino-acid" what is meant is any compound containing at least one carboxylic group and at least one primary, secondary or tertiary amino-group. In general, the natural amino-acids are utilized where the amine group is in the alpha position. Among the amino-acids can be cited glycine, alanine, serine, cysteine, cystine, proline, lysine, arginine, sarcosine or their derivatives. Among the amino-acid derivatives can be cited the ammonium salts and the salts formed with oxides or hydroxides of metals belonging to Groups I and II of the Periodic Table of Elements. The dicarboxylic amino-acids such as aspartic acid and especially glutamic acid are particularly suitable. Instead of free diacids, it is also possible to utilize their derivatives such as the salts, the monoesters or monoacids, for example, glutamine or asparagine. If the amino-acid or its derivative is insoluble in the oil or in the reaction medium, it can be added as a microdispersion in oil, such as described in French Patent Application No. 85 14663, mentioned herein above.

The term "surfactant" denotes a molecule comprised of a hydrocarbon-based lipophilic part and a hydrophilic part. The hydrophilic part can be selected from among the group comprising sulfonic acid, carboxylic acid, phenolic acid, phosphonic or thiophosphonic acid. The compounds are used in their metallic salt forms.

The surfactants preferred within the scope and spirit of the present invention are the petroleum or synthetic sulfonates of the metals comprised within Groups I or II. More particularly, the alkylarylsulfonates such as alkylbenzene sulfonates, alkyltoluene sulfonates and alkylxylene sulfonates having a linear or branched chain with 9 to 36 carbon atoms are utilized. Preferably, the dialkylbenzene sulfonates, such as $C_{24}$-alkylbenzene sulfonate, are used.

Among the alkaline-earth metals can preferably be used, calcium, magnesium or barium in the hydroxide, alcoholate or oxide form.

The reaction medium comprises a diluent oil of a paraffinic (100 NS ®) or naphthenic (100 PS ®) type of a hydrocarbon-based solvent and of a polar solvent. The hydrocarbon-based solvents are either aliphatic hydrocarbons, for example, containing 6 to 8 carbon atoms, or aromatic hydrocarbons such as benzene, toluene or xylene. Among the polar solvents can be preferably used the oxygen-based solvents such as water or an alcohol, preferably methanol or their mixtures.

In order to produce the additive according to the invention, the surfactant, amino-acid or alkaline-earth metal derivative such as the salt, monoester or monoamide is contacted with an alkaline-earth metal utilized in its oxide, hydroxide or alcoholate form in the presence of a nitrogen-based basic derivative in a medium comprising a diluent oil, a hydrocarbon-based solvent and a polar solvent. This mixture is subjected to vigorous stirring while beginning the introduction of the carbon dioxide. The reaction is exothermic. The mixture is maintained at a temperature varying from 20° to 80° C. and preferably, from 35° to 70° C. during the carbonation step. The pressure is comprised between 0.8 and 2 bars and preferably, between 0.9 and 1.1 bars. The carbonation time varies between 0.5 and 8 hours. At the end of the reaction, the residual solids are eliminated through centrifugation. The volatile compounds such as ammonia and the solvents used are eliminated through distillation or evaporation.

It is possible to add diluent oil prior to the elimination phase without impairing the properties of the finished product.

The additive is in the form of a translucid solution having a good fluidity. It is stable for a long time and compatible with the other additives normally used in lubricating oils.

The products obtained have alkaline values determined according to ASTM D 2896 standard higher than 300. In addition to its detergent action and its use as basicity reserve, it presents an antiwear action. This antiwear action is rendered evident through tests on a FALEX machine according to the ASTM 2670 standard.

The additives obtained according to the invention are utilized in lubricating oils of natural or synthetic origin. They are employed in quantities comprised between 0.01 and 30% by weight and preferably, comprised between 0.5 and 15% by weight.

The following examples illustrate the invention, without however limiting the same.

EXAMPLE 1

Into a 250 ml. capacity reactor equipped with a stirrer, a carbon dioxide intake, a cooling agent and a thermometer are introduced a mixture of 50% in moles of calcium glutamate dispersed at 36% in a 750 Pale ® oil (or 32.5 g), 50% in moles of $C_{24}$-alkylbenzene sulfonic acid at 70% (or 20.4 g), 30 g of calcium oxide, 22.5 g of diluent oil (100 Neutral), 150 ml of xylene, 10 ml of methanol and a solution of 1.16 g ammonium carbonate in 10.5 g of water.

The mixture is subjected to vigorous stirring (700 t/mn), while the introduction of the carbon dioxide begins at a speed of 103 ml/mn.

The reaction is exothermic. The addition of carbon dioxide is completed over a period of 75 mn. At the end of the reaction, 50 ml of xylene are added to the mixture, which thereafter, undergoes a centrifugation in order to eliminate the residual solids.

The liquid phase is subjected to an evaporation in order to eliminate the volatile components ($NH_3$, water, methanol and xylene).

A co-overbased solution is obtained (formed from glutamate and sulfonate of calcium) having an alkaline value of 387 mg of KOH/g and a viscosity of 120 cSt at 100° C. The solution has a translucid appearance. Transmission electronic microscopy reveals the presence of particles having a diameter comprised between 100 and 200 μm. Furthermore, energy loss spectroscopic analysis (EELS) confirms the presence of nitrogen in the nucleus or ring of the particles of the colloidal dispersion obtained, which confirms the incorporation of the calcium glutamate in these particles. The antiwear properties of the additive are rendered evident by the FALEX tests (ASTM 2670 standard).

Conditions: 3 h - 900 lbs (408 kg)

Additive introduced at 19% in the oil (600 N+bright stock) containing dispersants.

| | Oil Without Additive | Oil + 0.3% ZDTP* | Oil + Additive | Oil + Additive + 0.3% ZDTP* |
|---|---|---|---|---|
| Teeth | rupture at 15° | rupture at 30° | 125 | 17 |
| Couple | — | — | 15 | 17 |

*ZDTP = zinc dialkyldithiophosphate.

EXAMPLE 2

The experiments described in Example 1 are repeated, apart from the fact that a mixture comprising 80% in mole calcium glutamate at 36% dispersed in the oil (750 PALE or 52 g) and 20% in mole of $C_{24}$ alkylbenzene sulfonic acid at 70% (or 8.18 g) is utilized.

A co-overbased solution of glutamate and sulfonate of calcium is obtained having an alkaline value of 335 mg of KOH/g and a viscosity of 31 cSt at 100° C.

EXAMPLE 3

The experiments described in Example 1 are repeated, apart from the fact that a mixture comprising 50 mole percent of dispersed calcium aspartate at 41% in the oil (750 PALE) or 26.12 g and 50 mole percent of $C_{24}$ alkylbenzene sulfonic acid at 70% (or 20.4 g) is utilized.

A co-overbased solution of aspartate and sulfonate of calcium having an alkaline value of 395 mg of KOH/g and a low viscosity is obtained.

EXAMPLE 4

The experiments described in Example 1 are repeated, apart from the fact that a mixture comprising 80% in mole of calcium aspartate dispersed at 41% in the oil (750 PALE) and 20 mole percent of $C_{24}$ alkylbenzene sulfonic acid at 70% (or 8.18 g) is utilized.

A co-overbased solution of aspartate and sulfonate of calcium having an alkaline value of 350 mg of KOH/g and a low viscosity is obtained.

EXAMPLE 5

(Comparative)

A mixture of overbased glutamate and sulfonate of calcium can be obtained through simple formulation by adding the overbased sulfonate to a dispersion of calcium glutamate in the oil (750 PALE). Into a flask of 125 ml capacity are introduced 25 g of calcium aspartate at 36% in a mixture of oil and dispersant (this corresponds to an alkaline value of 200 mg of KOH/g) and 25 g of calcium sulfonate (or 50% by weight) overbased having an alkaline value of 413 g of KOH/g.

The mixture is stirred for several minutes. A homogeneous solution having a fluid with a milky appearance is obtained (formed from glutamate and sulfonate of calcium) having an alkaline value of 306 ml of KOH/g.

EXAMPLE 6

(Comparative)

Into a flask of 125 ml capacity are introduced 40 g of calcium glutamate at 36% in the oil (750 PALE - this corresponds to an alkaline value of 200 mg of KOH/g) and 10 g of calcium sulfonate (or 20% by weight) overbased having an alkaline value of 413 mg of KOH/g.

The mixture is stirred for several minutes. A homogeneous solution having a fluid with a milky appearance and an alkaline value of 242 mg of KOH/g is obtained.

Examples 5 and 6 show that an overbased solution of glutamate and sulfonate of calcium can be obtained by formulation but that it has, in any case, an alkaline value lower than that obtained by co-overbasing of the glutamate/sulfonate couple (as in the case of Examples 1 and 2).

What is claimed is:

1. A process for preparing a basic additive having antiwear and detergent effects for lubricating oils comprised of:

(1) forming a mixture consisting essentially of (a) an amino-acid ammonium salt or an amino-acid salt of an oxide or hydroxide of metals from Group I and II of the periodic table elements, (b) a sulfonic acid salt surfactant, (c) an alkaline-earth metal derivative in a diluent oil mixture comprised of a hydrocarbon-based solvent and polar solvent, and (d) a nitrogen-based basic derivative selected from the group consisting of ammonia and ammonium carbonate, wherein the mixture contains from 0.05 to 1 mole of surfactant and amino-acid salt or derivative per mole of alkaline sum of the moles of surfactant plus moles of amino-acid salt in the mixture is from 0.05 to 1 mole per mole of alkaline-earth metal derivative in the mixture wherein the ratio of moles of surfactant to moles of amino acid salt is from 1:4 to 99:1; and (2) contacting the mixture, at a temperature in the range of from 20° to 80° C., with carbon dioxide in an amount of from 0.1 to 1.5 moles of carbon dioxide per mole of alkaline-earth metal derivatives in the mixture, whereby the basic additive is formed.

2. A process according to claim 1 wherein 0.05 to 0.2 moles of said surfactant and amino-acid salt sum per mole of alkaline earth metal derivative are employed.

3. A process according to claim 1 wherein said surfactant and amino-acid salt sum contains between 50 and 95 mole percent of surfactant.

4. A process according to claim 1, wherein the nitrogen-based basic derivative is ammonia.

5. A process according to claim 1, wherein the nitrogen-based basic derivative is ammonium carbonate.

6. A process according to claim 1, wherein the amino-acid if said salts are selected from the group consisting of glycine, alanine, serine, cysteine, cystine, proline, lysine, arginine and sarcosine.

7. A process according to claim 1, wherein the surfactant is selected from the group consisting of the alkylbenzene sulfonates, alkyltoluenesulfonates, alkylenesulfonates having a linear or branched chain with 9 to 36 carbon atoms and dialkylbenzene-sulfonate.

8. A process according to claim 1, wherein the polar solvent comprises an oxygen-based solvent selected from the group consisting of water, an alcohol and mixtures thereof.

9. A process according to claim 1, wherein the mixture is contacted at a temperature of from 35 to 70° C. under a carbon dioxide pressure of between 0.8 and 2 bars over a period of between 0.5 and 8 hours.

10. A basic additive for use in lubricating oils, prepared according to the process of claim 1.

11. A lubricating composition comprising a natural or synthetic lubricating oil and from 0.1 to 30% by weight of an additive of claim 10.

12. A process according to claim 1, wherein the amino-acid of said salt is selected from the group consisting of glutamic acid and aspartic acid.

13. A process according to claim 1, wherein the amino-acid of said salt is selected from the group consisting of glutamine or asparagine.

14. A process according to claim 1, wherein the diluent oil contains a paraffinic oil or a naphthenic oil.

15. A process according to claim 1, wherein the hydrocarbon-based solvent is an aliphatic hydrocarbon, containing 6 to 8 carbon atoms, or an aromatic hydrocarbon selected from the group consisting of benzene, toluene and xylene.

* * * * *